United States Patent [19]

MacWilliams

[11] Patent Number: 4,696,217

[45] Date of Patent: Sep. 29, 1987

[54] HARP AND IMPROVED STATIONARY NUT

[75] Inventor: William MacWilliams, Oakbrook Terrace, Ill.

[73] Assignee: Lyon & Healy Harps Inc., Chicago, Ill.

[21] Appl. No.: 913,983

[22] Filed: Oct. 1, 1986

[51] Int. Cl.[4] ..... G10D 1/04

[52] U.S. Cl. ..... 84/266

[58] Field of Search ..... 84/264–266

[56] References Cited

U.S. PATENT DOCUMENTS

| | | | |
|---|---|---|---|
| 437,917 | 10/1890 | Durkee | 84/266 |
| 485,354 | 11/1892 | Rath | 84/266 |
| 786,275 | 4/1905 | Ekman | 84/266 |
| 1,005,157 | 10/1911 | Clark | 84/264 |
| 1,105,879 | 8/1914 | Clark | 84/264 |
| 1,518,191 | 12/1924 | Folsom | 84/264 |

OTHER PUBLICATIONS

Lyon & Healy Literature.

*Primary Examiner*—Lawrence R. Franklin

[57] ABSTRACT

An improved stationary nut for a harp, for adjusting the position of a harp string relative to sharpening pins of an action plate, includes: an annular collar defining a central bore and, on its outer surface, a generally circumferential groove sized and adapted to be engaged by the harp string, and an elongated shaft sized and adapted to extend through the central bore for fastening the annular collar to the harp. The relative axes of the elongated shaft and the generally circumferential groove defined about the collar are different, and relative rotation between the collar and the shaft is effective to change the radial distance of a segment of the groove surface supporting the harp string from the axis of the shaft in a manner to change the position of the string relative to the sharpening pins, whereby the harp string may be centered on the action plate, between the sharpening pins, for improved playing tone. A harp employing the improved stationary nut is also described.

4 Claims, 9 Drawing Figures

HARP AND IMPROVED STATIONARY NUT

This invention relates to harps and, in particular, to stationary nuts for harps.

A harp is a muscial instrument having, typically, about 46 or 47 strings. Each string is held at one end by a tuning pin and at the other end is tied to a soundbox, usually formed of wood. A harp tone nut is disposed near each tuning pin, at a position selected so that the string is of length to vibrate at the proper note when plucked. Action plates are selectively operatable by means of pedals to rotate bringing sharpening pins into contact with the selected strings, foreshortening the string to raise by a semitone the note sounded when the string is plucked.

Over time, and through frequent use, the strings of the harp tend to drift laterally as the wood of the soundboard weakens. This drift results in the strings no longer being centered between the sharpening pins of the action plate, resulting in intermittent buzzing or resonance when the harp string is plucked. Durkee U.S. Pat. No. 437,917 thought to correct this defect by adjusting the rotation of the action plates.

The objective of this invention include providing means for adjusting the position of a harp string between sharpening pins on an action plate; providing a tone nut having means for adjusting the distance of the harp-string-engaging surface from the tone pin axis; providing a tone nut that allows adjustment of the position of the harp string relative to the sharpening pins by simple means; and providing a tone nut adapted to permit repeated adjustments of harp string position.

SUMMARY OF THE INVENTION

According to the invention, in a stationary nut for a harp, the stationary nut adapted to be engaged for a limited length extent circumferentially by a harp string extending from a tuning pin, about the stationary nut to a soundboard, the string, between the stationary nut and the soundboard, extending betwen sharpening pins of an action plate, there is an improvement wherein, for adjusting the position of the string relative to the sharpening pins of the action plate, the stationary nut comprises: an annular collar defining a central bore and, on its outer surface, a generally circumferential groove sized and adapted to be engaged by the harp string, and an elongated shaft sized and adapted to extend through the central bore for fastening the annular collar to the harp, the relative axes of the elongated shaft and the generally circumferential groove defined about the collar being different, and relative rotation between the collar and the shaft is effective to change the radial distance of a segment of the groove surface supporting the harp string from the axis of the shaft in a manner to change the position of the string relative to the sharpening pins whereby the harp string may be centered on the action plate, between the sharpening pins, for improved playing tone.

In the preferred embodiment, the elongated shaft has the form of a threaded bolt, and the collar is adapted for rotation thereabout; and the generally circumferentially groove about the collar is eccentric from the axis of the central bore.

According to another aspsect of the invention, in a musical harp comprising a soundboard and a multiplicity of harp strings, and a stationary nut adapted to be engaged for a limited length extent circumferentially by a harp string extending from a tuning pin, about the stationary nut to a soundboard, the string, between the stationary nut and the sound board, extending between sharpening pins of an action plate, there is an improvement wherein, for adjusting the position of the string relative to the sharpening pins of the action plate, the stationary nut comprises: an annular collar defining a central bore and, on its outer surfaces, a generally circumferential groove sized and adapted to be engaged by the harp string, and an elongated shaft sized and adapted to extend through the central bore for fastening the annular collar to the harp, the respective axes of the elongated shaft and the generally circumferential groove defined about the collar being different, and relative rotation between the collar and the shaft is effective to change the radial distance of a segment of the groove surface supporting the harp string from the axis of the shaft in a manner to change the position of the string relative to the sharpening pins, whereby the harp string may be centered on the action plate for improved playing tone of the harp.

Other features and the advantages of the invention will be apparent from the following description of the preferred embodiment, and from the claims.

DESCRIPTION OF THE PREFERRED EMBODIMENT

The drawings will first briefly be described.

Drawings

Figure 3:
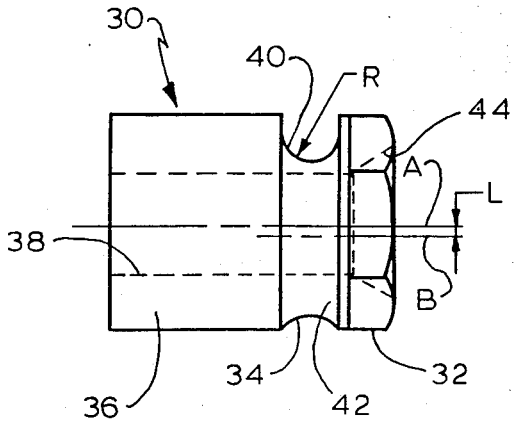
Figure 3A:
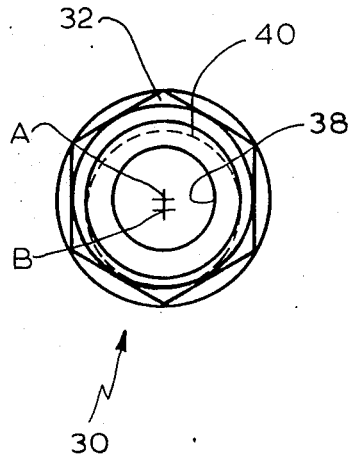
Figure 4:
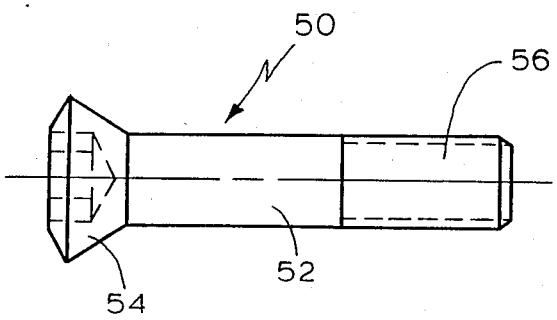
Figure 4A:
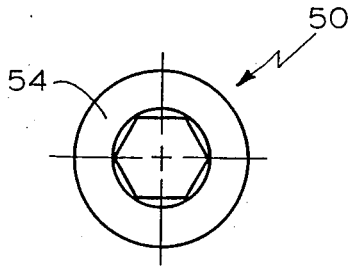
Figure 5:
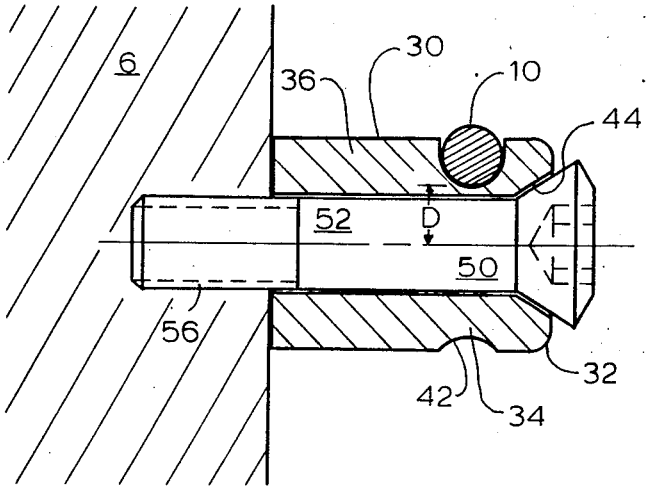
Figure 6:
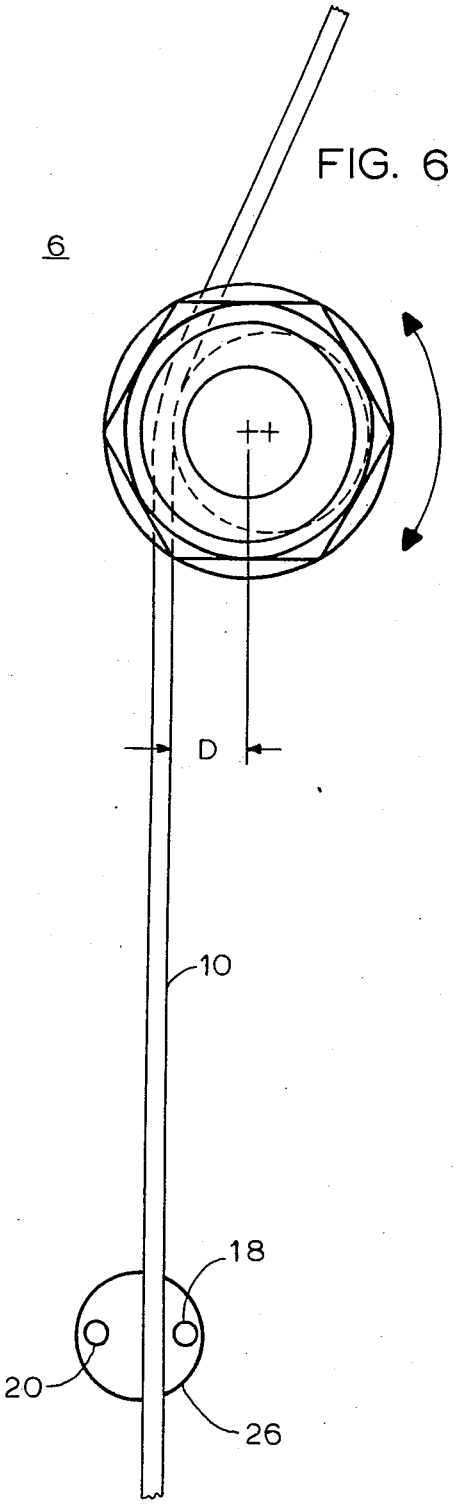
Figure 6A:
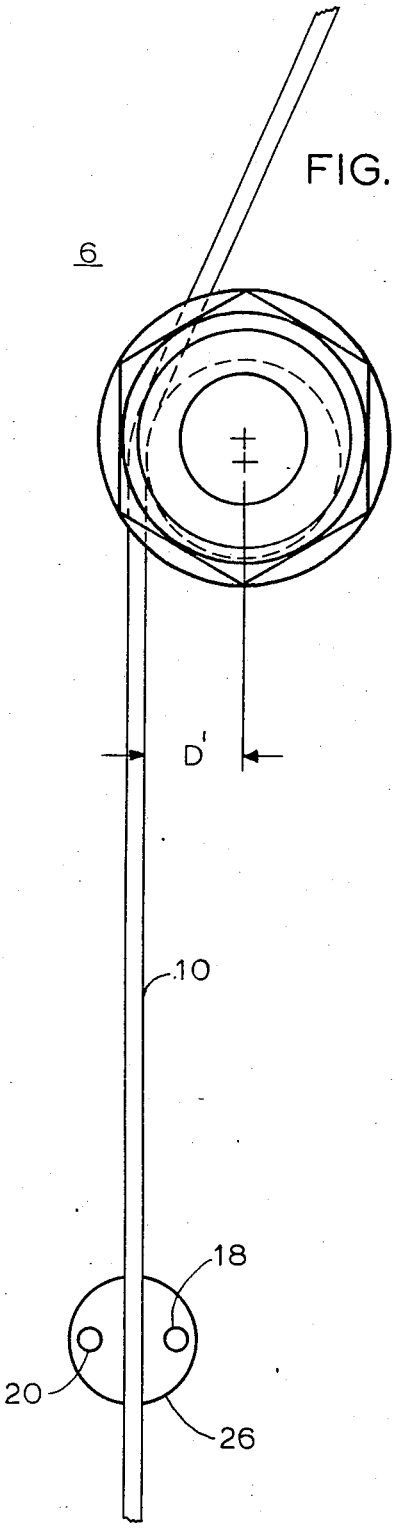

FIGS. 3 and 3*a* are side and plan views respectively of the annular collar portion of the adjustable stationary nut of the invention;

FIGS. 4 and 4*a* are side and plan views respectively of the elongated shaft portion of the adjustable stationary nut of the invention;

FIG. 5 is a side view, partially in section of the adjustable stationary nut of the invention installed in a harp; and FIGS. 6 and 6*a* are somewhat diagrammatic representations of the stationary nut and action plate of a harp, with the harp string shown, respectively, before and after adjustment of the stationary nut of the invention.

Structure

Figure 1:
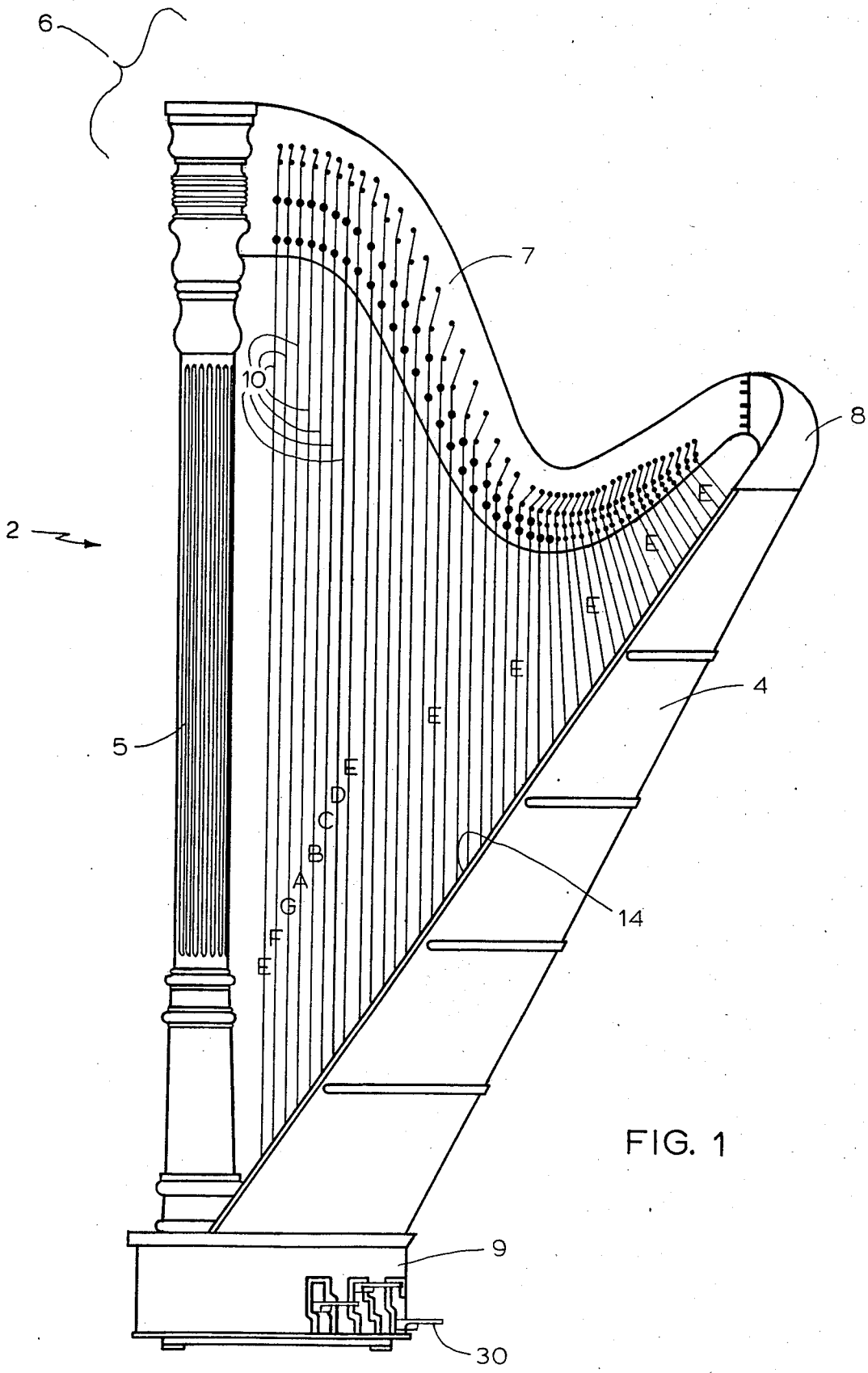
FIG. 1 is a front view of a musical harp employing stationary nuts of the invention.
Figure 2:
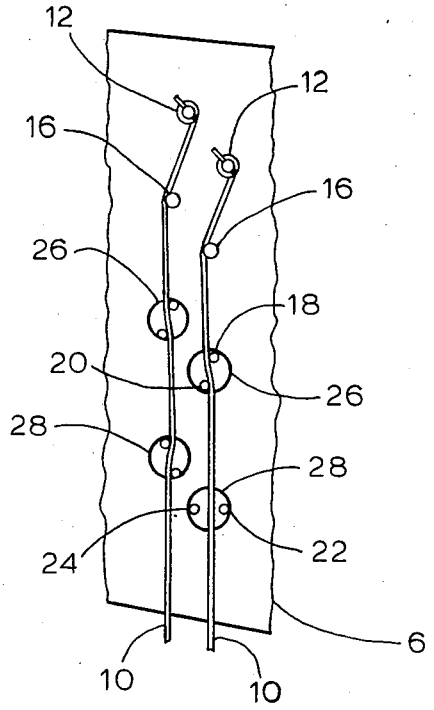
FIG. 2 is an enlarged plan view of the head of a harp and the upper ends of a pair of harp strings.

Referring to FIG. 1, harp 2, a typical six-octave, 46 string instrument, shown by way of example, consists of body 4, column 5, head 6, elbow 7, neck 8 and pedal box 9. Each octave consists of seven strings 10, each string respresenting a whole note designated by A, B, C, D, E, F, or G. Referring also to FIG. 2, each string 10 is held at one end to the head portion of the instrument, as shown, or to the elbow or neck, by tuning pin 12, which may be rotated to adjust string tension, and at the other end is tied to the soundboard 14, usually made of wood, e.g., spruce. Near to tuning pin 12, the string 10 extends about stationary nut 16, which is positioned to provide a predetermined length of string between the soundboard and the stationary nut to cause the string to vibrate at the proper frequency for the desired tone when the string is plucked. The string between the stationary nut and soundboard also extends across action plates 26, 28, between outwardly extending sharpening pins 18, 20 and 22, 24. The action plates are actuated by means of pedals 30 (FIG. 1), which cause the action plates to rotate, bringing the sharpening pins into contact with the string, thereby foreshortening the string and raising the note played a semitone.

Referring to FIGS. 3 and 3*a*, and also to FIGS. 4 and 4*a*, the adjustable stationary nut 16 of the invention consists of annular collar 30 and an elongated shaft 50. Collar 30 has a hexagonal head 32, an eccentric neck 34 and a body 36. Defined on axis, A, of collar 30 is a central bore 38 sized to receive shaft 50, as described below. Neck 34 is formed by groove 40 extending generally circumferentially about the collar, the center axis, B, of the groove being offset from axis, A, of the collar by a distance, L, e.g., about 0.032 inch, in a manner whereby the radial distance from the axis, A, to the surface 42 of the groove 40 varies rotationally. The surface 42 of the groove is dimensioned to provide support to the surface of the harp string and has a radius, R, selected to correspond generally to the radius of the string.

Elongated shaft 50, shown in FIGS. 4 and 4*a*, has the form of a fastening screw, with an elongated body 52 sized for insertion through center bore 38 of collar 30 and a head 54 sized to engage upon the face surface 44 of the collar to restrict incidental rotation. The other end of shaft 50 is threaded 56 for fastening into the harp. The head of the screw defines an hexagonal socket, sized to receive a driver for tightening the screw into the harp.

Referring to FIG. 5, the stationary nut 16 of the invention is shown assembled, attached to the head 6 of a harp, with a harp string 10 engaged for a limited length extent circumferentially in the groove 40, supported by surface 42.

Screw 50 has been tightened, e.g., using an hexagonal socket wrench, while holding collar 30 in a desired position. When screw 50 has been tightened, collar 30 can still be rotated relataive to screw 50 by using a second hexagonal wrench sized to engage about collar head 32. In this manner, the distance, D, between the surface of the groove engaged by the string and the axis, A, of the elongated shaft is adjusted.

Use

Referring to FIGS. 6 and 6*a*, collar 30 is shown fixed to harp head 6 (for simplicity, the fastening screw 50 is not shown) with string 10 engaged upon the surface 42 of groove 40 and passing between sharpening pins 12, 20 of action plate 26. In FIG. 6, string 10 is off-center between sharpening pins 18, 20, e.g., due to passage of time or frequent use, in a position where the string may vibrate against the sharpening pins and create disturbing noises when the harp is played.

According to the invention, by rotating collar 30, using hexagonal wrench, groove 40 is rotated eccentrically in a manner whereby the radial distance, D, between the center axis A of the fastening screw and the point on the surface 42 of groove 40 where the string is supported, is increased, e.g., to D', in FIG. 6*a*, to move the string to the center of the action plate 26, between sharpening pins 18, 20. Since the length of string 10 has beeen unaltered by rotation of collar 30, and the tension on string 10 can be adjusted using tuning pin 12 (FIG. 2), the tone of the string can be corrected to conform to its original tone, and the disturbing noises eliminated.

Other embodiments of the invention are within the following claims.

What is claimed is:

1. In a stationary nut for a harp, said stationary nut adapted to be engaged for a limited length extent circumferentially by a harp string extending from a tuning pin, about said stationary nut to a soundboard, said string, between said stationary nut and said soundboard, extending between sharpening pins of an action plate, the improvement wherein, for adjusting the position of said string relative to said sharpening pins of said action plate, said stationary nut comprises:

an annular collar defining a central bore and, on its outer surface, a generally circumferential groove sized and adapted to be engaged by said harp string, and an elongated shaft sized and adapted to extend through said central bore for fastening said annular collar to said harp, the relative axes of said elongated shaft and said generally circumferential groove defined about said collar being different, and relative rotation between said collar and said shaft is effective to change the radial distance of a segment of the groove surface supporting the harp string froom the axis of the shaft in a manner to change the position of said string relative to said sharpening pins, whereby, the said harp string may be centered on the action plate, between the sharpening pins, for improved playing tone.

2. The stationary nut of claim 1 where said elongated shaft has the form of a threaded bolt, and said collar is adapted for rotation thereabout.

3. The stationary nut of claim 1 wherein said generally circumferentially groove about said collar is eccentric from the axis of said central bore.

4. In a musical harp, comprising a soundboard and a multiplicity of harp strings, and a stationary nut adapted to be engaged for a limited length extent circumferentially by a said harp string extending from a tuning pin, about said stationary nut to a soundboard, said string between said stationary nut and said soundboard, extending between sharpening pins of the action plate, the improvement wherein, for adjusting the position of said string relative to said sharpening pins of said action plate, said stationary nut comprises:

a annular collar defining a central bore and, on its outer surface, a generally circumferential groove sized and adapted to be engaged by said harp string, and an elongated shaft sized and adapted to extend through said central bore for fastening said annular collar to said harp, the respective axes of said elongated shaft and said generally circumferential groove defined about said collar being different, and relative rotation between said collar and said shaft is effective to change the radial distance of a segment of the groove surface supporting the harp string from the axis of the shaft in a manner to change the position of said string relative to said sharpening disk, whereby the said harp string may be centered on the action plate for improved playing tone of said harp.

* * * * *

UNITED STATES PATENT AND TRADEMARK OFFICE

CERTIFICATE OF CORRECTION

PATENT NO. : 4,696,217

DATED : September 29, 1987

INVENTOR(S) : William MacWilliams

It is certified that error appears in the above-identified patent and that said Letters Patent are hereby corrected as shown below:

Col. 1, line 41, "between" is misspelled;

Col. 1, line 65, "aspect" is misspelled;

Col. 2, line 54, "representing" is misspelled;

Col. 3, line 39, "relative" is misspelled.

Signed and Sealed this

Twenty-sixth Day of April, 1988

*Attest:*

DONALD J. QUIGG

*Attesting Officer*

*Commissioner of Patents and Trademarks*